United States Patent [19]

Hiroshima

[11] Patent Number: 4,754,112

[45] Date of Patent: Jun. 28, 1988

[54] COOKING APPLIANCE WITH VAPOR SENSOR AND COMPENSATION FOR THE EFFECT OF INTERMEDIATE FOOD HANDLING ON THE SENSED AMOUNT OF VAPOR

[75] Inventor: Masako Hiroshima, Nara, Japan

[73] Assignee: Sharp Kabushiki Kaisha, Osaka, Japan

[21] Appl. No.: 16,259

[22] Filed: Feb. 19, 1987

[30] Foreign Application Priority Data

Feb. 19, 1986 [JP] Japan ..... 61-23291[U]

[51] Int. Cl.[4] ..... H05B 6/68

[52] U.S. Cl. ..... 219/10.55 B; 219/10.55 E; 219/489; 99/325

[58] Field of Search ..... 219/10.55 B, 10.55 R, 219/10.55 E, 10.55 M, 489, 509, 518; 99/325, 326, 327, 328, 451, DIG. 14; 426/243, 523

[56] References Cited

U.S. PATENT DOCUMENTS 3,932,675 1/1976 Main ..... 426/233
4,162,381 7/1979 Buck ..... 219/10.55 B
4,166,137 8/1979 Buck ..... 219/10.55 M X
4,316,068 2/1982 Tanabe ..... 219/10.55 B
4,350,860 9/1982 Ueda ..... 219/10.55 B
4,396,817 8/1983 Eck et al. ..... 219/10.55 M

FOREIGN PATENT DOCUMENTS 0052871 11/1981 European Pat. Off. .

*Primary Examiner*—Philip H. Leung
*Attorney, Agent, or Firm*—Birch, Stewart, Kolasch & Birch

[57] ABSTRACT

A cooking appliance has a sensor for detecting vapor generated from heated food and a control circuit which controls heating of the food according to signal outputs from the sensor. The control circuit is operated so as to ignore signal outputs from the sensor for a specified period of time after the food is reversed and/or its position is changed before the sensor has detected the heated state detection point to compensate for an accumulation of vapor during the intermediate food handling.

4 Claims, 2 Drawing Sheets

COOKING APPLIANCE WITH VAPOR SENSOR AND COMPENSATION FOR THE EFFECT OF INTERMEDIATE FOOD HANDLING ON THE SENSED AMOUNT OF VAPOR

BACKGROUND OF THE INVENTION

The present invention relates to a cooking appliance such as a microwave oven or an electric oven for heating objects including food.

Conventionally, a microwave oven with a moisture sensor determines that the food is completely heated by detecting the amount of vapor generated from the heated food. The output from the moisture sensor increases as vapor is generated from the heated food. When the output reaches a specified value (detection point), an additional heating time required for completing the food is calculated on the basis of a constant stored in an LSI control circuit. The oven then continues heating the food for the calculated period of time and then stops heating so that the most optimally heated food can be obtained. The time constant is different for different foods. For a certain kind of food, the user may be required to open the oven door in the middle of the heating process and to reverse and/or change the position of the food for more uniform heating. Usually, this intermediate food handling operation is carried out when the sensor output reaches the detection point level. For some foods, however, the intermediate food handling operation may be necessary at an earlier time. Frozen Hamburger Patties which are among the list of foods to be cooked by a sensor-equipped oven is an example of a food that needs to be reversed and/or moved in the middle of cooking so as to be uniformly heated. The sensor output increase for this food is, however, very slow. If the food is heated until the output reaches the detection point, therefore, it may be overheated locally, depending upon the quantity. If the food is reversed and/or moved at this stage, optimally heated food cannot be expected. That is, depending upon the quantity, the food may be required to be reversed and/or moved earlier than the detection point. One to three frozen hamburger patties can be optimally cooked if they are reversed and/or moved at the detection point. Four to six hamburger patties could be overheated locally if they were not moved until the detection point; they must be moved earlier than the detection point.

FIG. 2 shows the relationship between sensor output and heating time for four or more hamburger patties which are supposed to be heated each in a case.

Here, the detection point level of sensor output is considered to be 10 bits. The oven is designed to carry out additional heating for a specific time period after the sensor output reaches 10 bits. When the oven door is opened to take out the hamburger patties and reverse and/or change the positions in the middle of heating, part of the vapor generated from the food and accumulated within the heating chamber flows out of the oven, so that the output of the detector sensor drops. It begins rising again when the food is returned and heated again in the oven. Therefore, if this intermediate food handling operation is conducted before the sensor output reaches the detection point, the time required for the output to reach the detection point is a little longer than that in the case where the oven door is not opened until the detection point is reached. An arithmetic operation for calculating the additional heating time required after the detection point is reached takes account of this time lag.

If this intermediate food handling operation is carried out before the detection point is reached, in the oven instead of outside the oven, vapor and heat accumulated within the case are released all at once into the heating chamber when the case covers are opened. The vapor thus released partly flows into the exhaust duct leading to the detector sensor which is installed immediately above the heating chamber. Moreover, the magnetron cooling fan which generates an air stream in the heating chamber stops, when the door is opened, causing the vapor to stay in a part of the exhaust duct.

If the door is then closed and the heater is actuated with this state, the magnetron is energized and the magnetron cooling fan starts operating. This generates air current which sends the vapor in the exhaust duct to the detector sensor. When the sensor output at the intermediate food handling operation time (TA) is close to the detection point as shown in FIG. 2, the sensor output will reach the detection point immediately after the heating is resumed. As a result, the oven will be turned off before the food is sufficiently heated.

SUMMARY OF THE INVENTION

To overcome the above conventional problem, an object of the present invention is to provide a cooking appliance capable of heating food optimally even if the oven door is opened to reverse and/or change the position of the food in the heating chamber at a specified time in the middle of the heating process before the sensor output reaches the detection point.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

A cooking appliance of the present invention comprises a detector element for sensing a physical amount of vapor generated by heating the food and a control circuit for controlling heating means according to the output from the detector element. When the user reverses and/or changes the position of the food at a specified time (W1 of FIG. 2), according to the signal output from the detector element, before the signal output reaches a predetermined detection point level, the control circuit does not read the signal output from the detector element for a specified period of time (W2 of FIG. 2), say, about 30 to 60 seconds after heating is resumed, so that vapor accumulated in the exhaust duct in the area near the detector element is released outside the oven during the above specified period of time, thereby enabling the detector element to accurately detect the vapor amount in the heating chamber.

According to the present invention, if the oven door is opened to reverse the food before the detection point is reached, the control circuit will not read the signal output from the detector element for a specified period of time after the door is closed and heating is resumed. During this specified period, the large amount of vapor accumulated in the exhaust gas duct near the detector element can be released, stabilizing the vapor amount in the exhaust duct, which facilitates accurate detection of the vapor amount. Therefore, in cooking a large quantity of food in the cooking chamber, if the oven door is opened to carry out the intermediate food handling operation in the heating chamber at a predetermined time before the output reaches the detection point, the detector element can detect the vapor amount accurately, so that additional heating is conducted for an adequate period of time to yield optimally cooked food. According to the present invention, the user can reverse and/or change the position of the food at a timing most suitable to obtain uniformly heated food, irrespective of the quantity of the food.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
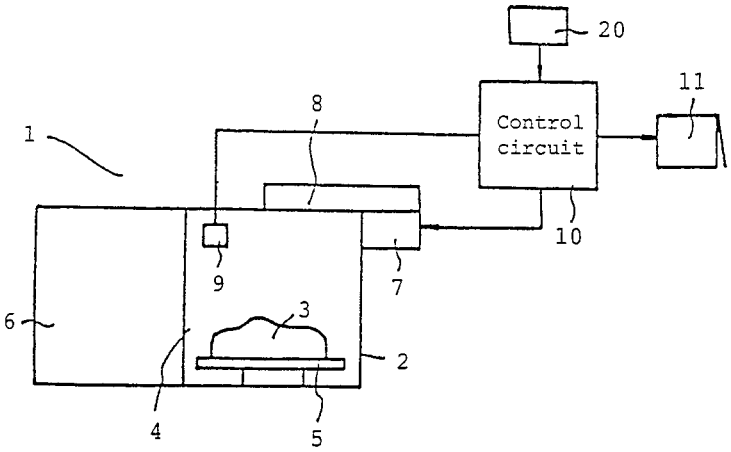
FIG. 1 is a schematical drawing of the microwave oven of the present invention viewed from the front.

FIG. 1 is a schematical drawing showing a microwave oven 1 of an embodiment of the present invention viewed from the front. The housing 2 of the microwave oven 1 contains a cooking chamber 4 in which to heat food 3. The food 3 is placed on a turntable 5. The housing 2 has a door 6 for airtightly closing the cooking chamber 4. Electromagnetic wave energy from heater means 7 realized by a magnetron or the like is supplied through a wave guide 8 to the cooking chamber 4, to heat the food 3. An exhaust duct (not shown) is provided in the upper part of the housing 2 so that vapor generated from the food 3 heated in the cooking chamber 4 is led to the oven exterior. A detector element 9 is provided in the exhaust duct to detect the vapor amount. A signal output from the detector element 9 is sent to a control circuit 10 which is connected with a time setter 20 retaining constants for various foods. When the signal output from the detector element 9 reaches a predetermined first discrimination level l1 (See FIG. 2), the control circuit 10 reads the constant of the food being heated from the setter 20. Using this constant, the control circuit 10 calculates the appropriate additional heating time for the food and controls the heater means 7 to continue heating the food for the calculated period of time. The control circuit 10 is connected to an alarm generating buzzer 11 which informs the user of the intermediate food handling timing—the time for opening the oven door 6 to reverse and/or change the position of the food 3.

Figure 2:
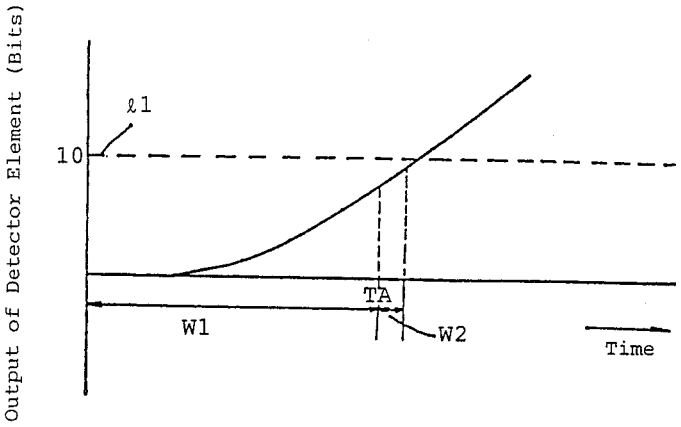
FIG. 2 is a graph showing the relationship between the output of the detector element and the heating time for four hamburgers.
Figure 3:
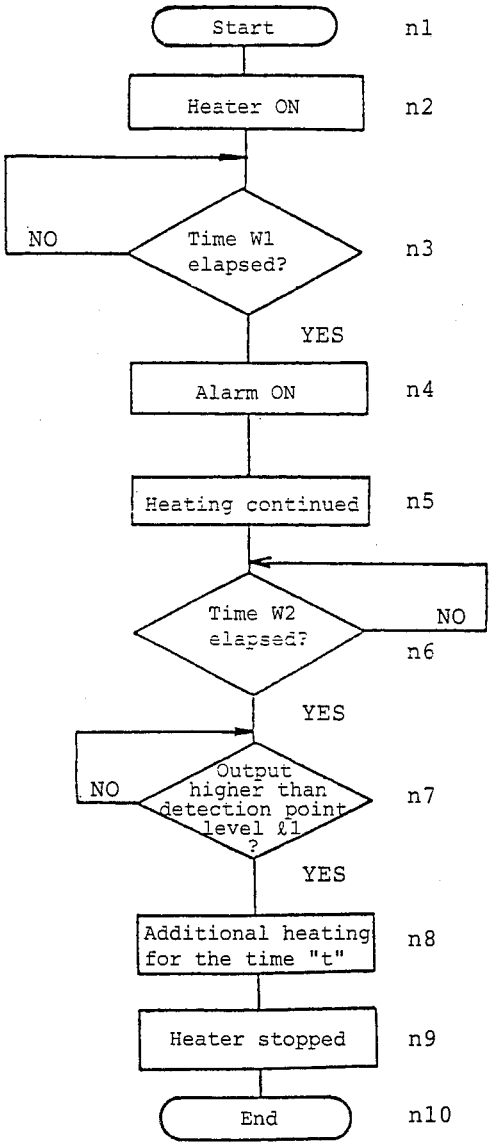
FIG. 3 is a flowchart of the procedures for controlling the microwave oven in heating food.

FIG. 2 shows the relationship between the output of the detector element 9 and the heating time for four Frozen Hamburger Patties (hereinafter called hamburgers). FIG. 3 is a flowchart of the procedures for cooking food in the microwave oven 1 of the present invention.

When operation starts at step n1, the heater means 7 begins heating the food 3 in the step n2. In the step n3, it is judged whether or not the predetermined time W1 has elapsed. The time W1 is usually shorter than the time required for the output of the detector element 9 to reach the detection point level l1. For four or more hamburgers, for example, the time W1 is about three minutes. When the time W1 has elapsed, the operation process moves to the step n4 where the buzzer 11 sounds an alarm, informing the user of the intermediate food handling time. Then the user opens the door 6, reverses and/or changes the position of the food and closes the door 6. At the same time as the heating operation is resumed, the operation process moves to the step n6 where it is judged whether or not the predetermined period W2 has elapsed since the heating was resumed after the intermediate food handling operation. For four or more hamburgers, the time W2 is about 30 seconds.

In the step n7, it is judged whether or not the signal output from the detector element 9 has reached the detection point level l1. In this embodiment of the invention, an output level of 10 bits is selected for the detection point level l1. If the detection point level l1 has not been reached in the step n7, the heater means 7 continues heating the food 3 until the detector output reaches the level l1. When the level l1 is reached, the control circuit 10 reads the time constant for the food being cooked from the setter 20 and calculates the appropriate additional heating time "t". In the step n8, the food 3 is further heated by the heater means 7 for the time "t". Then the heater means 7 is stopped in the step n9 and the heating process ends in the step n10.

As understood from the above description, the detector output signal is not read for a specified period of time after the intermediate food handling operation. Therefore, if the detector output reaches the detection point level within the specified period of time after the intermediate food handling operation which was conducted before the output reached the detection point level, or specifically after the four hamburgers have been heated for three minutes, the control circuit ignores the signal output, thus preventing the heater means from being turned off before the food is heated sufficiently.

In the above embodiment, description is given for the case where frozen hamburger patties are heated in the cooking heater. The present invention may also be used for heating any other object if it can be heated.

According to the present invention, when heating is resumed after the intermediate food handling operation is conducted before the detector output reaches a specified value fixed for each food (in other words, after the food is heated for a predetermined period of time), the control circuit does not read the detector signal output for a specified period of time.

According to the present invention, since the control circuit does not read the detector signal output for the specified period of time after the heating operation is resumed following the intermediate food handling operation, the vapor accumulated in the exhaust duct leading to the detector element is allowed to be released outside the oven, resulting in a stabilized vapor amount in the exhaust duct. This enables the detector element to sense an accurate amount of vapor generated in the heating chamber and facilitates the carrying out of the intermediate food handling operation at the most optimal time for the food, irrespective of the detection point level, whereby the food can be heated uniformly and optimally.

According to the present invention, even if the oven door is opened before the detector output reaches the detection point level, the detector element senses the vapor amount accurately so that additional heating can be carried out for the period most suitable to yield optimally cooked food, and that food of any quantity can be heated uniformly because intermediate food handling operation timing can be selected appropriately according to the quantity of the food.

While only certain embodiments of the present invention have been described, it will be apparent to those skilled in the art that various changes and modifications may be made therein without departing from the spirit and scope of the present invention as claimed.

What is claimed is:

1. A cooking appliance for cooking food including heater means for heating the food, comprising:

sensor means for detecting a physical amount of vapor generated by the food as it is being heated and producing an output signal representative of said amount of vapor; and control means for controlling the operation of said heater means, including, means for turning off said heater means in response to intermediate handling of the food by a user prior to completion of a cooking operation, means for reactivating said heater means in response to completion of said intermediate handling, means for receiving said output signal from said sensor means, means for turning off said heater means a first predetermined time after receiving an output signal from said sensor means representing a predetermined amount of vapor, and means for preventing said receiving means from receiving said output signal for a second predetermined time after completion of said intermediate handling.

2. A cooking appliance as defined in claim 1, further comprising means for storing first predetermined times, second predetermined times, and predetermined vapor amounts for a plurality of different types of food.

3. A cooking appliance as defined in claim 1, further comprising alarm means for informing a user to reverse the position of the food in said appliance after a third predetermined time from initiation of heating.

4. A cooking appliance as defined in claim 1, wherein said heater means comprises a microwave generator.

* * * * *